US005716285A

United States Patent [19]

Maceri

[11] Patent Number: 5,716,285

[45] Date of Patent: Feb. 10, 1998

[54] POOL BALL RACK AND SPILL ZONE ATTACHMENT

[76] Inventor: Francesco Antonio Maceri, 206 The Strand, Bedford, Western Australia 6052, Australia

[21] Appl. No.: 479,209

[22] Filed: Jun. 7, 1995

[30] Foreign Application Priority Data

Jun. 10, 1994 [AU] Australia ..... 64663/94

[51] Int. Cl.[6] ..... A63D 15/00

[52] U.S. Cl. ..... 473/40

[58] Field of Search ..... 473/40, 41

[56] References Cited

U.S. PATENT DOCUMENTS

| | | | |
|---|---|---|---|
| 230,652 | 8/1880 | Parker | 473/41 |
| 269,825 | 11/1883 | Bugg | 473/41 |
| 293,458 | 2/1884 | Hausman | 473/41 |
| 294,200 | 2/1884 | Collender | 473/41 |
| 1,499,407 | 7/1924 | Savoie | 473/41 |
| 1,703,448 | 2/1929 | Horstmann | 473/41 |
| 1,743,891 | 1/1930 | Horstman | 473/41 |
| 1,887,552 | 11/1932 | Gunn | 473/41 |
| 1,919,296 | 7/1933 | Grantonic | 473/41 |
| 2,469,252 | 5/1949 | Jones | 473/40 |
| 3,236,519 | 2/1966 | Leigh | 473/41 |
| 3,368,810 | 2/1968 | Geering | 473/41 |
| 3,423,087 | 1/1969 | Sowa | 473/41 |
| 3,627,321 | 12/1971 | Sardo | 473/41 |
| 3,729,914 | 5/1973 | Miller | 473/41 |
| 3,794,319 | 2/1974 | Miller | 473/41 |
| 3,863,919 | 2/1975 | Sardelli | 473/40 |
| 3,929,333 | 12/1975 | Kremiski | 473/41 |
| 4,103,773 | 8/1978 | Haber | 473/41 |
| 4,591,051 | 5/1986 | Lowman | 473/41 |

FOREIGN PATENT DOCUMENTS

| | | | |
|---|---|---|---|
| 329 | of 1905 | United Kingdom | 473/41 |
| 2099313 | 12/1982 | United Kingdom | 473/41 |
| 2180165 | 3/1987 | United Kingdom | 473/41 |
| 2188245 | 9/1987 | United Kingdom | 473/41 |
| 2229370 | 9/1990 | United Kingdom | 473/40 |
| 2234914 | 2/1991 | United Kingdom | 473/41 |

*Primary Examiner*—Theatrice Brown
*Attorney, Agent, or Firm*—Larson & Taylor

[57] ABSTRACT

A ball frame assembly 10 for use in a ball game played on a table. The ball frame assembly 10 comprises a base 12 slidably mounted in a frame 14. The base 12 comprises a triangular plate 16 having an upstanding wall 18 fixed on one side thereof. The base 12 further comprises a male locking component 20 fixed midway along an inside face of the wall 18. The base 12 also comprises a liner, in this example a rubber liner 27, covering an upper face of the triangular plate 16. The frame 14, in the shape of an equilateral triangle, has three interconnected sides or retaining walls 28A, 28B, 28C. Each of the two walls 28A, 28B have receiving means, in this embodiment a longitudinal groove 32, for slidably receiving each of the edges of the triangular plate 16. The frame 14 further comprises a female locking component 34 fixed to the retaining wall 28C in a position so that the male locking component 20 can mate therewith when the base 12 is in a closed position. There is a spill tray 47 defining a spill zone between the upstanding wall 18 and the opposing retaining wall 28C. A frame zone 62 is defined by a region bound by the three interconnected retaining walls 28A, 28B, 28C of the frame 14. The ball frame assembly 10 can be adapted to be used with a conventional pool table. With the base 12 in the closed position the ball frame assembly is located below the table so as to receive balls. The ball frame assembly 10 is then moved to the playing surface of the table and the base 12 moved into an open position so the balls are then resting on the playing surface. The ball frame assembly 10 can then be lifted clear of both the balls and the table. The game of pool can now commence with the balls positioned in their fixed relative position and location on the table.

7 Claims, 3 Drawing Sheets

POOL BALL RACK AND SPILL ZONE ATTACHMENT

FIELD OF THE INVENTION

The present invention relates to a bail frame assembly for use in a ball game played on a table and relates particularly, though not exclusively, to a ball frame assembly for use in a game of pool.

BACKGROUND OF THE INVENTION

In a game of pool there is provided a number of balls and a table. The table has an upper playing surface having a number of pockets around its perimeter through which the balls can fall. The pockets are interconnected below the playing surface by a series of passageways which lead to a common ball race. The ball race has an exit located above and adjacent a base tray, the base tray designed to receive the balls dropping from the ball race. The ball race and base tray are usually located on a side of the table which is accessible to a player.

With a coin-operated table the balls are prevented from dropping into the base tray by a gate which releases the balls upon insertion of the required coin. Tables for use at home do not usually incorporate this coin-operated gate and the balls are free to drop into the base tray via the ball race once they have fallen into any one of the interconnected pockets. The passageways and ball race slope in a downward direction so that gravity causes the balls to roll When in these locations.

To begin a game of pool, with all the balls located in the base tray, a player must reach into the base tray and transfer the balls onto the playing surface of the table by hand. The balls are either directly placed in a ball frame resting on the playing surface, or alternatively once all the balls have been placed on the playing surface they are then transferred to the frame. The frame is essential for correct placement of the balls at the commencement of a game of pool. Usually the frame is triangular in shape, and is designed to position the balls in a fixed position relative to each other and in a fixed predetermined location on the playing surface of the table. This procedure for arranging the balls is referred to as framing the balls. Once the balls have been framed, the frame is lifted away from the table, the balls remaining in the fixed relative position and location, and the game of pool can commence.

One of the drawbacks in the current method of framing the balls is the time to transfer the balls by hand from the base tray to the playing surface of the table. This is because it is usually only possible to handle a maximum of two balls per hand at a time. In removing the balls from the base tray the knuckles or skin on the back of the hand of a player may be bruised or grazed by an edge of the table adjacent the base tray. Furthermore, the repeated action of bending down and grasping the balls from the base tray may, particularly with elderly people, be fatiguing and/or lead to muscle strains.

Another problem in transferring the balls to the playing surface of the table relates to a felt material which lines the playing surface. When struck with a solid object, such as a pool ball, the felt is susceptible to permanent deformation resulting in a small hollow. These hollows in the playing surface detrimentally affect the roll of a ball and the table may eventually require a relining of the playing surface with new felt, which is both inconvenient and expensive.

A further problem with a conventional type pool table as described above is in connection with noise which occurs when the balls drop into the base tray. Particularly in a room with a large number of tables the noise generated can be great. This noise makes it difficult and generally inconvenient to maintain a conversation without having to shout.

SUMMARY OF THE INVENTION

The intention of the present invention is to provide a ball frame assembly for use in a ball game played on a table which is relatively quick, easy, quiet and convenient to use, with a reduced risk of damage to the table and injury to players.

According to the present invention there is provided a ball frame assembly for use in a ball game, including a table having a playing surface and a plurality of balls which can roll on said playing surface and fall to a level below said playing surface, said ball frame assembly comprising:

a ball frame defining a frame zone which can retain any number of said plurality of balls; and, a base coupled to said ball frame for movement between a closed position in which said base can support said balls and an open position in which said balls can be supported by the table while remaining in said frame zone whereby, in use, with the base in the closed position the ball frame assembly can be positioned relative to the table so that balls falling from said playing surface can be received within said frame zone, whereupon the ball frame assembly can then be moved to rest on the playing surface of the table and thereafter the base can be moved to the open position so that the balls can be supported on said playing surface and the ball frame assembly can then be lifted clear of both the balls and the playing surface of the table leaving each of the balls in a fixed relative position.

Preferably the ball frame assembly further comprises a spill tray operatively cooperating with said ball frame to define a spill zone for retaining any of said plurality of balls not retained within the frame zone.

Preferably the spill tray is connected to the base, the spill tray defining said spill zone for retaining balls not retained within the frame zone, when the base is in the closed position.

Preferably the base can slide in to and out of a receiving means provided in the ball frame, moving from said closed to said open position, respectively.

Preferably the ball frame comprises at least three interconnected sides defining the frame zone.

Preferably the ball frame assembly further comprises a liner covering a bearing surface of the frame assembly onto which the balls are received, the liner constructed of a material designed to reduce noise when any one of the balls impacts the liner when the ball frame assembly receives the balls.

Preferably the liner is constructed of a layered material including a layer of resilient material.

Preferably there is also provided a ball framing system comprising the ball frame assembly and levelling means adapted for connection to the table adjacent the ball frame assembly when said ball frame assembly is positioned for receiving balls, whereby, in use, said levelling means can contact any balls, not directly supported by said base and retained within the frame zone, moving said balls into the frame zone for support directly by said base or the spill zone when the ball frame assembly is withdrawn from the table.

Preferably said levelling means comprises a substantially planar surface located under the playing surface of the table.

BRIEF DESCRIPTION OF THE DRAWINGS

In order to achieve a better understanding of the nature of the present invention a preferred embodiment of a ball frame assembly wall now be described in detail, by way of example only, with reference to the accompanying drawings in which.

DETAILED DESCRIPTION OF THE PREFERRED EMBODIMENTS

As illustrated in the accompanying drawings there is a ball frame assembly 10 for use in a game of pool. The game includes a playing table, a set of balls (usually 16 for pool), and cues (not shown).

The ball frame assembly 10 comprises a base 12 slidably mounted in a frame 14.

Figure 5:
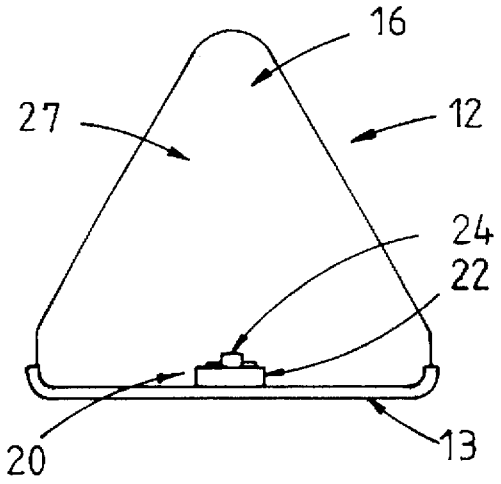
FIG. 5 is a plan view of a base of the ball frame assembly of FIG. 1.
Figure 6:
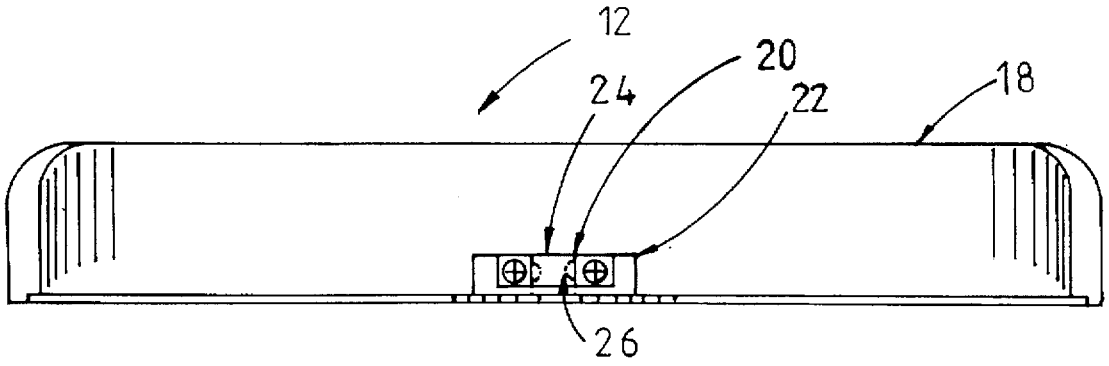
FIG. 6 is an end elevational view of the base of FIG. 5.

The base 12 comprises a triangular plate 16 in the shape of an equilateral triangle with radiused corners. An upstanding wall 18 is fixed to a side of the triangular plate 16 on which the balls are supported. The wall 18 is curved around each of the two radiused corners of the plate 16. The height of the wall 18 above the plate 16 is substantially equal to the diameter of each ball and progressively reduces in height around each corner. The base 12 further comprises a male locking component 20 fixed midway along an inside face of the wall 18 as best shown in FIGS. 5 and 6. The male locking component 20' has a mounting plate 22 with a key 24 fixed thereto. The key 24 has on each of its opposing faces a half spheroidal indentation 26.

The base 12 further comprises a liner in this example a rubber liner 27 covering an upper face of the triangular plate 16. This liner 27 is used to reduce noise generated when the balls fall into the ball frame assembly 10.

The frame 14, is in the shape of an equilateral triangle, having three interconnected sides or retaining walls 28A, 28B, 28C defining its perimeter. Two of the retaining walls 28A, 28B are extended at their mutually converging ends to form a handle 30. The handle 30 is shaped so as to fit comfortably in the palm of a hand when grasped by a player. The retaining walls 28A, 28B, 28C are each in a plane perpendicular to the triangular plate 16 of the base 12. Two of the retaining walls 28A, 28B have a height above the base 12 substantially equal to the diameter of the balls and the third wall 28C has a height above the base 12 smaller than the diameter of the ball. An upper edge of the third retaining wall 28C is progressively tapered away from each corner of the frame 14. A lower edge of the third wall 28C is likewise tapered to reduce contact and, therefore, friction between the triangular plate 16 of the base 12 and this retaining wall 28C.

Each of the two walls 28A, 28B have receiving means, in this embodiment a longitudinal groove 32, for slidably receiving each of the edges of the triangular plate 16. Each of the grooves 32 is located near a bottom edge of each retaining wall 28A, 28B and extends along its inside face.

The frame 14 further comprises a female locking component 34 consisting of a pair of opposing angle components 36. Each angle component includes a ball 38 housed in a bore 40 of the angle component 36. Each ball 38 is loaded into the bore 40 and biased in an outward direction by a compression spring (not shown). The angle component has a hole. 42 coaxial with the bore 40 through which the ball 38 exits. The hole 42 is of a smaller diameter than the maximum diameter of the ball 38. On an opposite side of the angle components 36 a grub screw (not shown) threadingly engages the bore 40 and forces the spring against the ball 38. The space defined between the opposing angle components 36 and the balls 38 defines a keyway 44. The female locking component 34 is fixed to the retaining wall 28C in a position such that the key 24 of the male locking component 20 is received in and engaged by the keyway 44. The spheroidal indentations 26 substantially correspond in shape and size to any surface of the ball 38 so as to mate therewith.

With the sides of the triangular plate 16 received in the corresponding grooves 32 of the retaining walls 28A, the upstanding wall 18 is pushed and the key 24 can lock in the keyway 44. The base 12 of the ball frame assembly 10 is now in a closed position. There is a spill tray 47 defining a spill zone between the upstanding wall 18 and the opposing retaining wall 28C.

The ball frame assembly 10 can be adapted to be used with a conventional pool table. A conventional table includes a playing surface having a series of pockets located around its perimeter, the pockets connected to a number of interconnected passageways. The passageways lead to a common ball race, the ball race feeding a base tray located on an underside of the table. Balls leaving the playing surface of the table, through any pocket, roll along the passageways, ball race, and into the base tray under the force of gravity.

Figure 1:
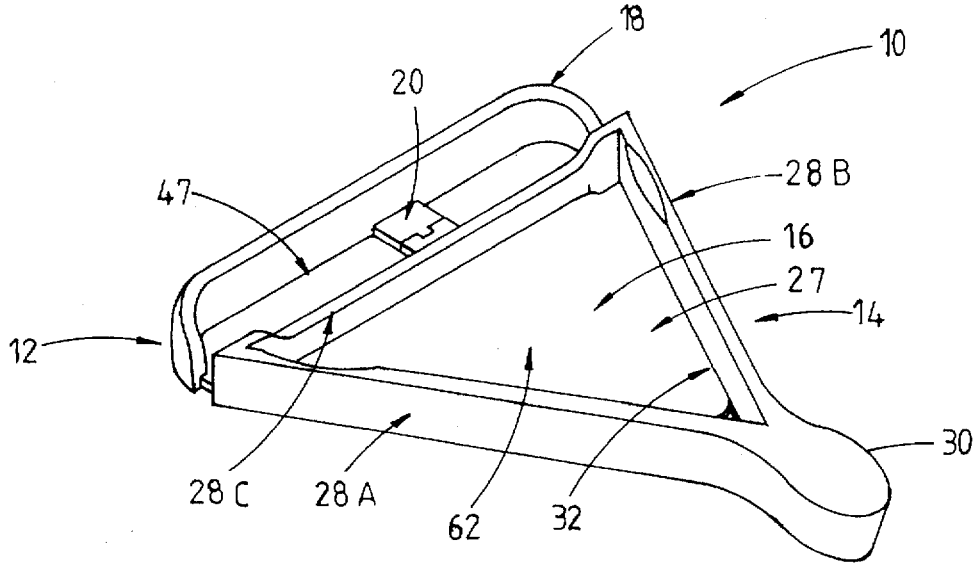
FIG. 1 is a top perspective view of a ball frame assembly of the present invention shown in a closed position.
Figure 2:
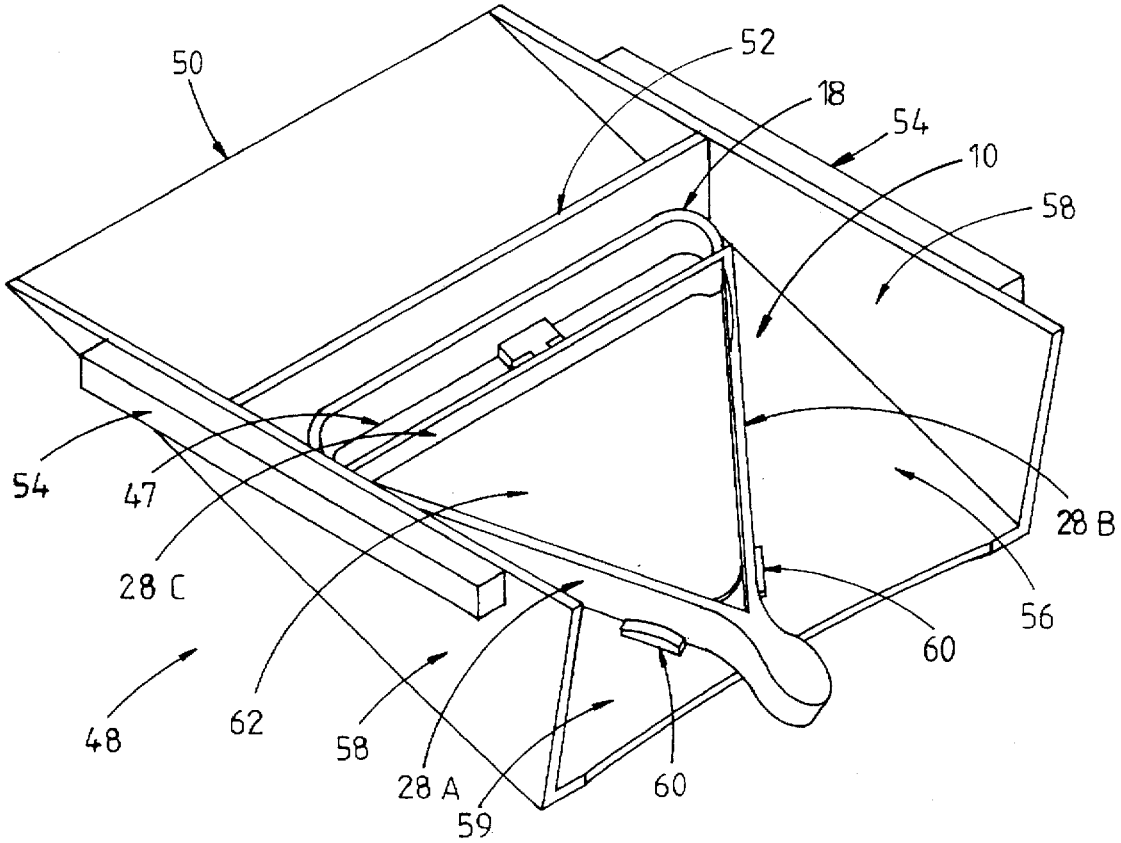
FIG. 2 is a top perspective view of the ball frame assembly of FIG. 1 located in a base tray of a pool table.
Figure 3:
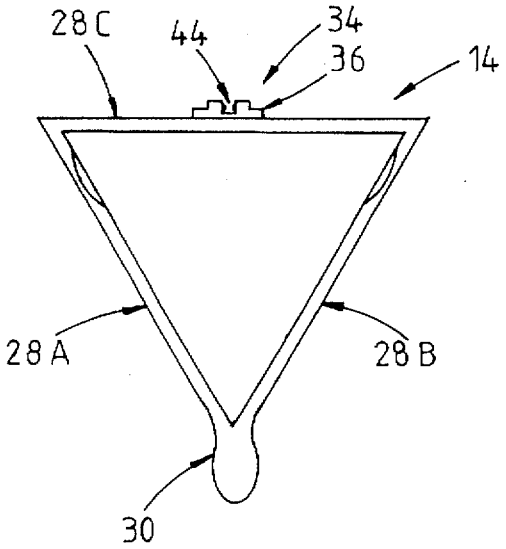
FIG. 3 is a plan view of a frame of the ball frame assembly of FIG. 1.
Figure 4:
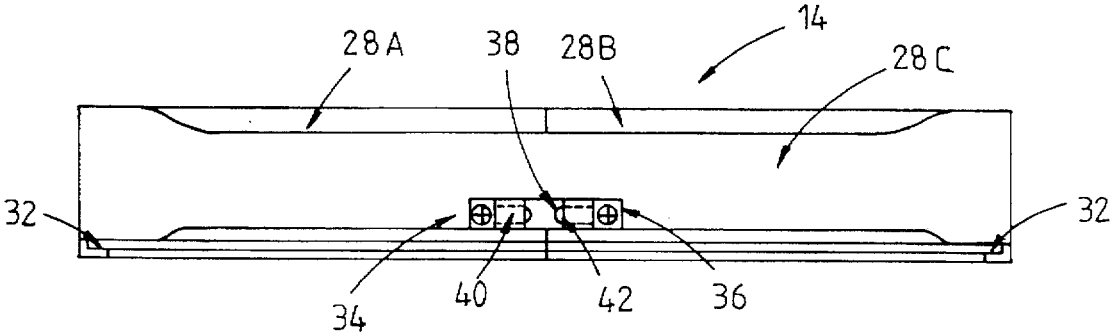
FIG. 4 is an end elevational view of the frame of FIG. 3.

The existing base tray can be modified to locate the preferred ball frame assembly 10 thereon or alternatively a substitute base tray 48 (as shown in FIG. 2) can be used. The base tray 48 is fixed on the underside of the table under and adjacent an exit of the ball race. The base tray 48 comprises a body 50, a rectangular rear partition 52 fabricated therein, and a pair of connecting flanges 54 for attaching the base tray 48 to the underside of the table. The body includes a rectangular base 56 and a pair of wedge shaped side walls 58 fixed perpendicular to opposing edges of the rectangular base 56. The rear partition 52 interconnects and is fixed to each of the side walls 58. The partition 52 extends to each of the side walls 58 and is also fixed to the rectangular base 56. The height of the partition 52 is substantially equal to the height of each side wall 58 where the partition 52 is fixed.

The handle 30 of the frame 14 overhangs the rectangular base 56 through a mouth 59 of the base tray 48 so the handle 30 can be easily grasped by a player when moving the ball frame assembly 10 to the playing surface of the table. The rectangular base 56 has on its upper face a pair of opposing blocks 60. Each block 60 is orientated so that, when the upstanding wall 18 of the base 12 bears against the partition 52, each of the two retaining walls 28A, 28B of the frame 14 can be lowered between the blocks 60, and the ball frame assembly 10 is held in a fixed planar position relative to the base tray 48.

With the frame assembly 10 resting in the base tray 48 as described above balls can then drop into the frame 14 from the ball race. Balls are received in a frame zone 62 defined by a region bound by the three interconnected retaining walls 28A, 28B 28C, of the frame 14. Because the frame zone 62 is shaped and sized so as to held all the balls in a fixed relative position not all balls may initially rest directly on the base 12 in a first tier. In this situation, a second tier of balls is formed above the first tier.

The pool table can further include levelling means, in this example a lower surface of the table located above the base tray 48. The ball frame assembly 10 and this lower surface together constitute a ball framing system. The lower surface is positioned at a height relative to the base tray 48 so that when the ball frame assembly 10 is withdrawn from the base tray 48 the lower surface contacts the second tier of balls. This then forces these balls either in to spaces in the frame 14 or toward the spill tray 47 of the ball frame assembly 10. The balls knocked into the spill tray 47 are then retained within the spill tray 47 as the ball frame assembly 10 is raised to and placed on the playing surface of the table.

Particularly with the game of pool, where the balls need to be located in specific positions within the frame 14, it is an advantage to have some balls contained in the spill tray 47. This is because there is then room in the frame zone 62 to locate each of the balls into its specific position with relative ease. When there is one or more balls contained in the spill tray 47 the balls are not closely packed. The balls in the frame 14 can then be moved without having to remove a ball from the frame 14 where they may have been closely packed. This feature of the ball frame assembly 10 helps in framing the balls.

Once the balls are located in their specific positions and the ball frame assembly 10 located in its predetermined position on the playing surface the base 12 can be moved into an open position. To open, the upstanding wall 18 of the base 12 is pulled in a direction away from the retaining wall 28C of the frame 14. The frame 14 is held on the handle 30 with the other hand so that the frame 14 remains stationary relative to the table. As the base 12 is opened each of the balls are free to rest on the playing surface of the table. Once fully open the ball frame assembly 10 can be carefully raised clear of both the playing surface of the table and the balls. The balls then remain on the table in their predetermined relative positions. The base 12 can then be moved into the closed position and returned to the base tray 48 as before described. The ball frame assembly 10 is now ready to receive the balls in anticipation of the next game of pool.

Now that a preferred embodiment of a ball frame assembly has been explained in some detail it will be apparent that the invention has a number of advantages over the prior art, including:

1. The procedure for framing balls does not involve the repeated action of bending over and transferring the balls from the base tray to the playing surface of the table but rather involves one action in transferring the ball frame assembly together with all the balls to the playing surface;
2. The balls need not be individually handled from the base tray to the playing surface thereby risking damage to the knuckles or back of the hand of a player;
3. There is a reduced risk of damaging the playing surface of the table when opening the tray of the ball frame assembly compared with the placing of balls on table by hand; and,
4. Excessive noise in connection with balls dropping into a conventional base tray is reduced by the above described embodiment of the present invention.

It will be apparent to persons skilled in the relevant arts that numerous variations and modifications can be made to the ball frame assembly in addition to those already mentioned above, without departing from the basic inventive concepts of the present invention. For example, the frame may not be triangular in shape and may hold the balls in another predetermined arrangement. The base may be opened by a swivelling or pivoting movement rather than a sliding movement as described above. Another variation which would still remain within the scope of the present invention would be to construct the retaining sides of the frame from a bar connected to a base with recessed grooves. All such variations and modifications are to be considered within the scope of the present invention the nature of which is to be determined from the foregoing description.

I claim:

1. A ball frame assembly for use in a ball game including a table having a playing surface and a plurality of balls which can roll on said playing surface and fall to a level below said playing surface, said ball frame assembly comprising:

a ball frame defining an inner frame area which can retain a specific number of said plurality of balls;

a base coupled to said ball frame for movement between a closed position in which said base can support said balls and an open position in which said balls can be supported by the playing surface of the table while remaining in said inner frame area; and, a spill tray operatively cooperating with said ball frame to define a spill zone for retaining any of said plurality of balls not retained within the inner frame area whereby, in use, with the base in the closed position the ball frame assembly can be positioned below the playing surface so that balls falling from said playing surface can be received either within said inner frame area or said spill zone, whereupon the ball frame assembly can be moved to rest on the playing surface of the table, any balls retained within the spill zone can manually be moved to the inner frame area, and thereafter the base can be moved to the open position so that the balls can be supported on said playing surface, and the ball frame assembly can then be lifted clear of both the balls and the playing surface of the table thereby leaving each of the balls in a fixed relative position.

2. The ball frame assembly according to claim 1 wherein the spill tray is connected to the base, and the spill tray defines said spill zone when the base is in the closed position.

3. The ball frame assembly according to claim 2 wherein the base can slide in to and out of a receiving means provided in the ball frame, moving from said closed position to said open position, respectively.

4. The ball frame assembly according to claim 3 wherein the ball frame comprises at least three interconnected sides defining the inner frame area.

5. The ball frame assembly according to claim 4 further comprising a liner covering a bearing surface of the frame assembly onto which the balls are received, the liner being constructed of a material designed to reduce noise when any one of the balls impacts the liner when the ball frame assembly receives the balls.

6. The ball frame assembly according to claim 5 wherein the liner is constructed of a layered material including a layer of resilient material.

7. The ball framing system according to claim 1 wherein said spill tray is connected to said base, said assembly further comprising means, mounted on said base, for connecting said base to said ball frame, thereby connecting said spill tray to said ball frame.

* * * * *